US005697150A

United States Patent [19]

Komuro et al.

[11] Patent Number: 5,697,150

[45] Date of Patent: Dec. 16, 1997

[54] METHOD FORMING AN ELECTRIC CONTACT IN A VACUUM CIRCUIT BREAKER

[75] Inventors: Katsuhiro Komuro; Yoshitaka Kojima; Yukio Kurosawa, all of Hitachi; Yoshio Koguchi, Hitachioota; Toru Tanimizu, Hitachi; Yoshimi Hakamata, Hitachi; Shunkichi Endo, Hitachi, all of Japan

[73] Assignee: Hitachi, Ltd., Tokyo, Japan

[21] Appl. No.: 490,607

[22] Filed: Jun. 7, 1995

Related U.S. Application Data

[62] Division of Ser. No. 265,733, Jun. 27, 1994, Pat. No. 5,557,083.

[30] Foreign Application Priority Data

Jul. 14, 1993 [JP] Japan ..... 5-173945

[51] Int. Cl.[6] ..... H01R 43/16

[52] U.S. Cl. ..... 29/875; 218/129; 228/179.1; 164/94

[58] Field of Search ..... 29/874, 875, 878, 29/527.1, 904; 218/127, 129, 84; 228/179.1, 195; 164/91, 94, 137; 200/265

[56] References Cited

U.S. PATENT DOCUMENTS

| | | | |
|---|---|---|---|
| 3,359,623 | 12/1967 | Gwyn, Jr. | 29/875 X |
| 4,471,184 | 9/1984 | Sano et al. | 218/127 |
| 4,584,445 | 4/1986 | Konshiwagi et al. | 29/875 X |
| 5,347,096 | 9/1994 | Bolongeat-Mobleu et al. | 218/84 |

FOREIGN PATENT DOCUMENTS

| | | | |
|---|---|---|---|
| 653715 | 8/1933 | Germany | 29/875 |
| 45424 | 8/1970 | Japan | 29/875 |
| 50-21670 | 7/1975 | Japan . | |
| 3-17335 | 9/1985 | Japan . | |
| 63-96204 | 4/1988 | Japan . | |

*Primary Examiner*—Peter Vo
*Assistant Examiner*—Khan Nguyen
*Attorney, Agent, or Firm*—Fay, Sharpe, Beall, Fagan, Minnich & McKee

[57] ABSTRACT

According to the present invention there are provided a highly reliable electrode of high strength which undergoes little change even with the lapse of time, and a method for making the same, as well as a vacuum valve using such electrode and a vacuum circuit breaker using such vacuum valve. The vacuum circuit breaker has a fixed electrode and a movable electrode, each comprising an arc electrode, an arc electrode support member for supporting the arc electrode, and a coil electrode contiguous to the arc electrode support member, the arc electrode, the arc electrode support member and the coil electrode being formed as an integral structure by melting, not by bonding, particularly the arc electrode support member and the coil electrode being constituted by a Cu alloy containing 0.05–2.5% by weight of at least one of Cr, Ag, W, V and Zr.

9 Claims, 10 Drawing Sheets

METHOD FORMING AN ELECTRIC CONTACT IN A VACUUM CIRCUIT BREAKER

This is a divisional application of U.S. Ser. No. 08/265,733, filed Jun. 27, 1994, now U.S. Pat. No. 5,557,083

BACKGROUND OF THE INVENTION

1. Field of the Invention

The present invention relates to a novel vacuum circuit breaker, a vacuum valve, or (vacuum switch), used in the same, an electric contact used in the vacuum valve, and a method for making the electric contact.

2. Description of the Prior Art

An electrode structure in a vacuum circuit breaker comprises a pair of fixed electrode and movable electrode. The fixed and movable electrodes each comprise an arc electrode, an arc electrode support member for supporting the arc electrode, a coil electrode contiguous to the arc electrode support member, and an electrode rod provided at an end portion of the coil electrode.

The arc electrode is exposed to arc directly for breaking a high voltage and a large current flow. In view of this point, the arc electrode is required to satisfy the basic conditions of large breaking capacity, high withstand voltage value, small contact resistance value (high electrical conductivity), high fusion resistance, little contact erosion and small chopped current value. However, it is difficult to satisfy all of these characteristics, so in general there is used an arc electrode material which satisfies particularly important characteristics according to for what purpose it is to be used, while somewhat sacrificing the other characteristics. As an example of a method for producing an arc electrode material for breaking high voltage and large current, a method of infiltrating Cu into Cr or Cr-Cu skeleton is disclosed in Japanese Patent Laid Open No. 96204/88. Further, a similar method is disclosed in Japanese Patent Publication No. 21670/75.

On the other hand, the arc electrode support member not only serves as a reinforcing member for the arc electrode but also exhibits the effect of generating a vertical magnetic field by adopting a suitable shape thereof. And as the material of the arc electrode support member there is used pure Cu which is superior in conductivity.

The coil electrode also serves as a reinforcing member for the arc electrode and the arc electrode support member, as disclosed in Japanese Patent Publication No. 17335/91, but its main functions are to make the arc electrode generate a vertical magnetic field which is attained by adopting a suitable shape of the coil electrode, allowing arc generated at the arc electrode to be diffused throughout the entire arc electrode, to effect forced cut-off. The material of the coil electrode is pure Cu like that of the arc electrode support member.

The electrode comprising such arc electrode, arc electrode support member, coil electrode and electrode rod is fabricated through the steps of production and machining of the arc electrode material, machining of the arc electrode support member, coil electrode material and electrode rod, as well as assembly and soldering of the components.

The arc electrode is fabricated in the following manner. First, an arc electrode material is produced by a so-called infiltration method wherein the powder of Cr, Cu, W, Co, Mo, W, V or Nb, or of an alloy thereof, is formed into a predetermined shape having predetermined composition and porosity, sintered, and thereafter molten Cu or alloy is infiltrated into the skeleton of the sitter, or by a so-called powder metallurgy method wherein the density is adjusted to 100% in the sintering step prior to the infiltration step. The arc electrode material thus produced is then formed into a predetermined shape by machining.

The arc electrode support member, coil electrode and electrode rod are each formed by cutting into a predetermined shape which facilitates generation of a vertical magnetic field from pure Cu.

The components which have thus been subjected to infiltration and subsequent machining are then assembled and thereafter soldered to give an electrode structure comprising a series of electrodes. According to the soldering method, a bonding material and a solder superior in wettability are inserted between adjacent ones of the arc electrode, arc electrode support member, coil electrode and electrode rod, and the temperature is raised in vacuum or in a reducing atmosphere to effect soldering. In this soldering method, however, considerable labor and time are required for alignment of the components at the time of their assembly for soldering, in addition to the labor and time required for machining, and a defect of soldering causes an accident such as breakage or drop-out of the electrodes. The electrode structure obtained by such a conventional method is inferior in all of uniformity, reliability and safety of electrode characteristics.

Recently, attempts to cut off high voltage and large current from the angle of design specifications of vacuum circuit breakers have been made. As an example, an improvement of the breaking performance has been made by increasing the breaking speed. As a result, however, the contact force between arc electrodes increases and an impulsive stress is imposed on the whole electrode structure at the time of opening or closing the electrodes, thus causing deformation of the electrodes with the lapse of time. Generally, an arc electrode material of high strength superior in breaking characteristic or fusion resistance is used as the arc electrode material, while pure Cu is used as the material of arc electrode support member, coil electrode and electrode rod. The yield strength of pure Cu is very low, and grooving is applied to a cross section for the purpose of creating a vertical magnetic field as mentioned above, so that there will occur deformation of the electrodes with the lapse of time because of being unbearable particularly against an impulsive stress. Such deformation of the electrodes causes inconvenience in the electrode opening/closing operation, fusion of the arc electrode, breakage or drop-out of the arc electrode, which may obstruct the opening/closing motion in an emergency.

SUMMARY OF THE INVENTION

It is the object of the present invention to provide a vacuum circuit breaker having highly reliable electrodes which exhibit little deformation with the lapse of time, as well as a vacuum valve for use in the vacuum circuit breaker, an electric contact for use in the vacuum valve and a method for making the electric contact.

The present invention resides in a vacuum circuit breaker including a vacuum valve having a fixed electrode and a movable electrode both within an insulating vessel, further including conductor terminals connected outside the vacuum valve to the fixed electrode and the movable electrode, respectively, disposed within the vacuum valve, and opening/closing means for driving the movable electrode through an insulated rod connected to the movable electrode, the fixed electrode and the movable electrode each having an arc electrode formed by an alloy of a refractory metal and a highly electroconductive metal and also having an arc electrode support member which supports the arc electrode and which is formed of the highly electroconductive metal, the arc electrode and the arc electrode support member being formed integrally with each other by melting of the highly electroconductive metal.

DETAILED DESCRIPTION OF THE INVENTION

Figure 1A:
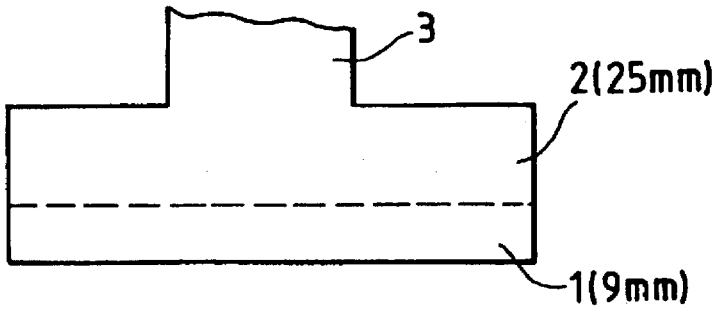
FIG. 1(*a–c*) is a process diagram showing an electric contact manufacturing process according to the present invention.

Preferably, the arc electrode is formed by an alloy which comprises one or a mixture of Cr, W, Mo and Ta and a highly electroconductive metal selected from Cu, Ag and Au or a highly electroconductive alloy mainly comprising such highly electroconductive metals, and the arc electrode support member is formed of such highly electroconductive metal or alloy.

More specifically, the arc electrode is preferably formed of an alloy containing 50–80 wt % as a total amount of one or more of Cr, W, Mo and Ta and 20–50 wt % of Cu, Ag or Au, and the arc electrode support member is preferably formed of an alloy comprising not more than 2.5 wt % as a total amount of one or more of Cr, Ag, W, V, Nb, Mo, Ta, Zr, Si, Be, Ti, Co and Fe and Cu, Ag or Au.

Further, the arc electrode used in the present invention is formed of an alloy comprising a perforated refractory metal and a highly electroconductive metal infiltrated therein, and it is formed integrally with the arc electrode support member by melting of the highly electroconductive metal.

The electrode support member used in the present invention has a 0.2% yield strength of not lower than 10 kg/mm$^2$ and a specific resistance of not higher than 2.8 μΩcm.

In at least one of the fixed electrode and movable electrode, the arc electrode support member is provided with a vertical magnetic field generating coil formed of a highly electroconductive metal. The said coil may be formed integrally with the electrode support member by soldering or by melting and solidifying of the highly electroconductive metal. The coil in question is in a cylindrical shape having a slit in its peripheral surface or having a generally fylfot cross section.

The vacuum valve is provided three sets for three phase, and preferably such three sets of vacuum valves are arranged side by side and mounted integrally within an insulating resin cylinder.

The present invention also resides in a vacuum valve having a fixed electrode and a movable electrode within an insulating vessel held in a high vacuum, the said electrodes each comprising an arc electrode formed by a composite of a refractory metal and a highly electroconductive metal and an arc electrode support member which supports the arc electrode and which is formed of the highly electroconductive metal, the arc electrode and the arc electrode support member being formed integrally with each other by melting of the highly electroconductive metal.

The construction of the electrodes and that of a magnetic field generating coil both used in this vacuum valve are the same as in the foregoing description.

The present invention further resides in an electric contact characterized in that an arc electrode formed by an alloy of a refractory metal and a highly electroconductive metal and an arc electrode support member formed of the highly electroconductive metal are formed integrally with each other by melting of the highly electroconductive metal. The said arc electrode is of the same construction as that described above.

The present invention further resides in a method for making an electric contact having an arc electrode formed by an alloy of a refractory metal and a highly electroconductive metal and an arc electrode support member which supports the arc electrode and which is formed of the highly electroconductive metal, characterized in that the arc electrode is formed by placing the highly electroconductive metal on a porous sinter having the refractory metal, then melting the highly electroconductive metal and allowing it to be infiltrated into the porous sinter, and that the arc electrode support member is formed by setting the thickness of the highly electroconductive metal remaining after the said infiltration to a thickness required as the electrode support member.

The method of the invention may include a heat treatment step wherein after the arc electrode and the arc electrode support member are formed by infiltration and solidification of the highly electroconductive metal, they are held at a desired temperature to precipitate supersaturatedly dissolved metal or intermetallic compound in the highly electroconductive metal.

The electric contact can be used for the fixed or the movable electrode of the vacuum valve.

According to the present invention, the arc electrode support member has a vertical magnetic field generating coil of a highly electroconductive metal, and both can be formed by melting and solidifying the highly electroconductive metal remaining after infiltration of the metal into the foregoing porous sinter into the thickness and coil required as the electrode support member and the vertical magnetic field generating coil.

The vacuum circuit breaker comprises the arc electrode, the arc electrode support member and an electrode rod, and a coil electrode is also used where required. The arc electrode is formed by a composite alloy of a refractory metal and a highly electroconductive metal. As the former metal there is used a high melting metal melting not lower than about 1,800° C. such as, for example, Cr, W, Mo or Ta, and the amount thereof dissolved is preferably not larger than 3% relative to the highly electroconductive metal. Pure Cu is particularly preferred as the material of the arc electrode support member, coil electrode and electrode rod, but since its strength is low, an iron material such as pure Fe or stainless steel is also used for reinforcement to thereby prevent deformation of the electrodes.

The composite alloy contains 50–80 wt %, particularly 55–65 wt %, of the refractory metal and 20–50 wt % of Cu, Ag or Au, and preferably it is prepared by melting and impregnating the highly electroconductive metal into a porous sinter of the refractory metal or the porous sinter containing a small amount, not larger than 10 wt %, of a highly electroconductive metal.

In the two-layer structure of the arc electrode and the arc electrode support member, the electrode support member reinforces and supports the arc electrode and its thickness is preferably a half of or larger than, more preferably equal to or larger than, the arc electrode. It is preferable that the porous sinter have a porosity of 50–70%. The refractory metal may contain one or more of Nb, V, Fe, Ti and Zr in an amount of 1 to 10 wt % relative to Cr in order to enhance the voltage withstand characteristic thereof.

The coil electrode may be produced by soldering of a highly electroconductive metal or by the same method as the casting technique at the time of infiltration into a porous refractory metal together with the arc electrode support member. Thus, the arc electrode, arc electrode support member and coil electrode can be constituted as an integral structure which is continuous metallographically. Consequently, the number of machining steps for the components and that of their assembling steps for soldering are reduced, and since bonding is not made, there no longer occur such conventional problems as local heat generation of soldered portions as well as breakage or drop-out of the arc electrode caused by defective soldering. In the case of forming the coil electrode by soldering, it is possible to use a composite material with ceramic particles dispersed therein.

According to the present invention, the arc electrode, arc electrode support member and coil electrode are thus formed as a metallographically continuous, integral structure, and in the same process as the integral electrode structure manufacturing process there are obtained the arc electrode support member and the coil electrode, thus permitting the use of an alloy comprising Au, Ag or Cu and one or more of Cr, Ag, W, V, Zr, Si, Mo, Ta, Be, Nb and Ti incorporated in an amount of 0.01 to 2.5 wt % in the Au, Ag or Cu. Therefore, the mechanical strength, particularly yield strength, of the arc electrode support member and that of the coil electrode can be greatly enhanced without great deterioration of their electrical conductivity. As a result, there can be attained sufficient resistance even to an increase in contact pressure between electrodes and an impact force induced at the time of opening or electrodes, whereby the problem of deformation with time can also be solved.

Thus, since the arc electrode, arc electrode support member and coil electrode are not bonded but are formed as an integral structure which is continuous metallographically and they are enhanced in strength, whereby the drawbacks involved in the conventional electrode are eliminated and hence it is possible to provide a vacuum circuit breaker which is higher in reliability and safety.

According to the present invention, the powder of Cr, W, Mo or Ta, or a mixture thereof with Cu, Ag or Au powder or any other metal particles in a predetermined composition, is formed into a predetermined shape so as to have a predetermined porosity and then sintered to obtain a porous sinter. Thereafter, a block of pure Cu, Ag or Au, or an alloy thereof, is put on the sinter and then melted, thereby allowing it to be infiltrated into the pores of the porous sinter. At this time, diffusion in liquid phase of the constituent elements of the sinter into the infiltration material is utilized positively to effect alloying of the same material in the foregoing content. The ingot obtained after completion of the infiltration is machined into a predetermined shape of electrode.

In the infiltration of the highly electroconductive metal, the amount of the porous sinter constituent metals to be dissolved into the highly electroconductive metal can be controlled by suitably setting the infiltration temperature and setting time. Such temperature and time are set in consideration of specific resistance and strength particularly relative to the arc electrode support member and the coil electrode. Of course, it is also possible to use an alloy obtained by adding alloy elements beforehand to the highly electroconductive metal, so the temperature and time in question are decided taking both factors into account. Accordingly, the resulting electrode is high in the foregoing mechanical strength and low in specific resistance and is therefore superior in its performance.

A desired electrode structure according to the present invention can be obtained by the combination of infiltration and casting technique in a desired shape as mentioned above. In this case, the final shape mentioned above can be attained by cutting.

The vacuum circuit breaker is used together with a disconnecting switch, an earthing switch, a lightning arrester or a current transformer. It is used as a high-tension receiving and transforming equipment which is essential as a power source in high-rise buildings, hotels, intelligent buildings, underground market, petroleum complex, various factories, stations, hospitals, halls, subway, and such public equipment as water supply and drainage equipment.

The present invention will be described below by way of working examples, but it is to be understood that the invention is not limited thereto.

EXAMPLE 1

Figure 1B:
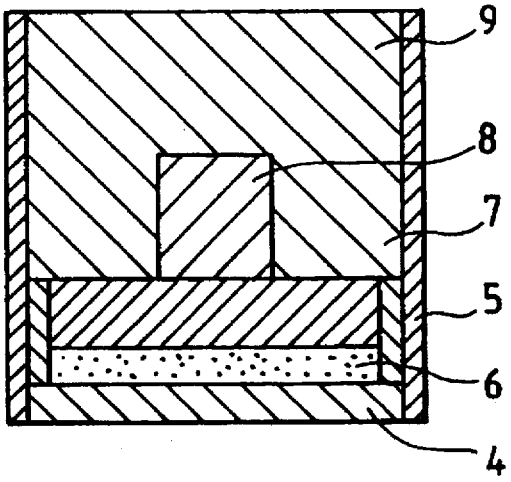
Figure 1C:
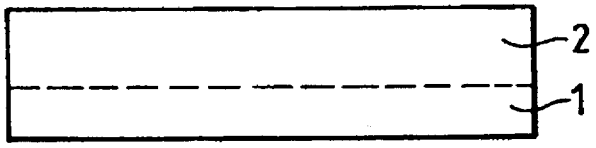

FIG. 1(*a*) shows an ingot section of an integral electrode structure produced on trial by the method of the present invention. In the same figure, the reference numeral 1 denotes an arc electrode, numeral 2 denotes an arc electrode support member, and numeral 3 denotes a feeder head of Cu for infiltration.

5 wt % Cu powder and 95 wt % Cr powder were mixed together by means of a twin-cylinder mixer and the resulting mixture was molded at a molding pressure of 1.5 ton/cmusing a mold of 80 mm in diameter to obtain a molded product having a diameter of 80 mm and a thickness of 9 mm. The molded product was then sintered in a hydrogen atmosphere at 1,200° C. for 30 minutes. The porosity of the resulting sitter was 65%.

Figure 2:
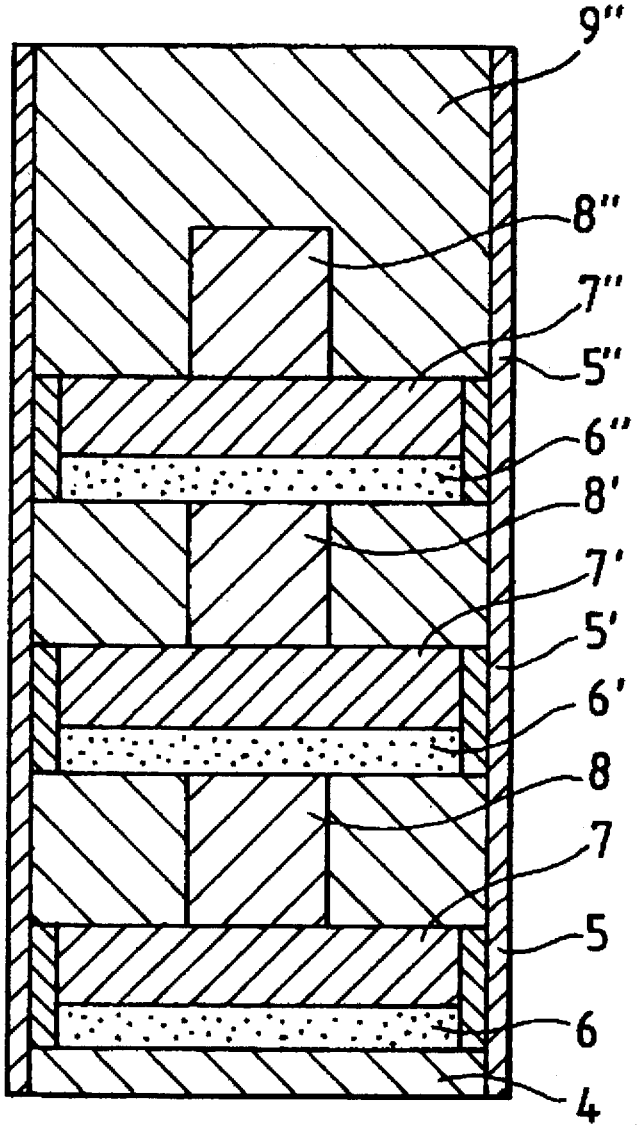
FIG. 2 is a sectional view of a mold for use in producing three electric contacts at a time.

FIG. 2(*b*) shows an electrode manufacturing process. As illustrated therein, there is used a graphite vessel 5 having an inside diameter of 90 mm, an outside diameter of 100 mm and a height of 100 mm with alumina ($Al_2O_3$) powder 4 of 100 to 325 mesh placed on the bottom at a thickness of about 10 mm. The above sinter, indicated at 6, is put centrally on the alumina powder in the vessel 5, and a member 7 of pure Cu having a diameter of 80 mm and a thickness of 15 mm and serving as an arc electrode support and coil electrode member is then placed concentrically with the sinter 6. Next, a member 8 of Cu as an infiltration material supply and feeder head member having a diameter of 28 mm and a length of 25 mm is placed concentrically with the member 7. The space between the inner surface of the graphite vessel 5 and the side faces of the two members 7, 8 and the space above the member 8 serving as an infiltration material and feeder head are filled with $Al_2O_3$ powder 9.

The infiltration is performed in the following manner. The vessel is held in a vacuum of $1\times10^{-5}$ Torr or lower at 1,200° C. for 90 minutes. The arc electrode support and coil electrode member 7 and the infiltration Cu supply and feeder head member 8 melt and the infiltration material is infiltrated into the skeleton of the sinter 6, followed by allowing to cool and solidify in a vacuum atmosphere. FIG. 1(*a*) shows an appearance of a section of the ingot taken out from the graphite vessel after solidification. FIG. 1(*c*) shows an arc electrode 1 and an arc electrode support member 2 both obtained after a cutting work for the ingot. As a result of observation of an interfacial portion of the two using a microstructural photograph, it turned out that Cu was infiltrated into the pores of the Cr sinter.

Thus, it is seen also from FIGS. 1(*a*) and 1(*c*) that an integral electrode structure of arc electrode, arc electrode support member and coil electrode can be produced by the method of the present invention. The arc electrode and the arc electrode support member are of the same thickness. Further, it is seen that the interface between the arc electrode and the arc electrode support member is completely continuous and integral metallographically, not requiring bonding by soldering or the like.

FIG. 2 shows an example in which the mold illustrated in FIG. 1(*b*) is used in three stages to permit production of three electrode structures at a time. In this Figure, reference numeral 5'–8' are similar to elements having reference numerals 5–8, but instead identify a second style. Similarly, reference numerals 5"–9" re used identify a third stage. The same method is also applicable to Example 2 below. The number of such mold stages is not limited to three. A desired number of mold stages can be adopted to produce the desired number of electrode structures at a time.

EXAMPLE 2

Figure 3:
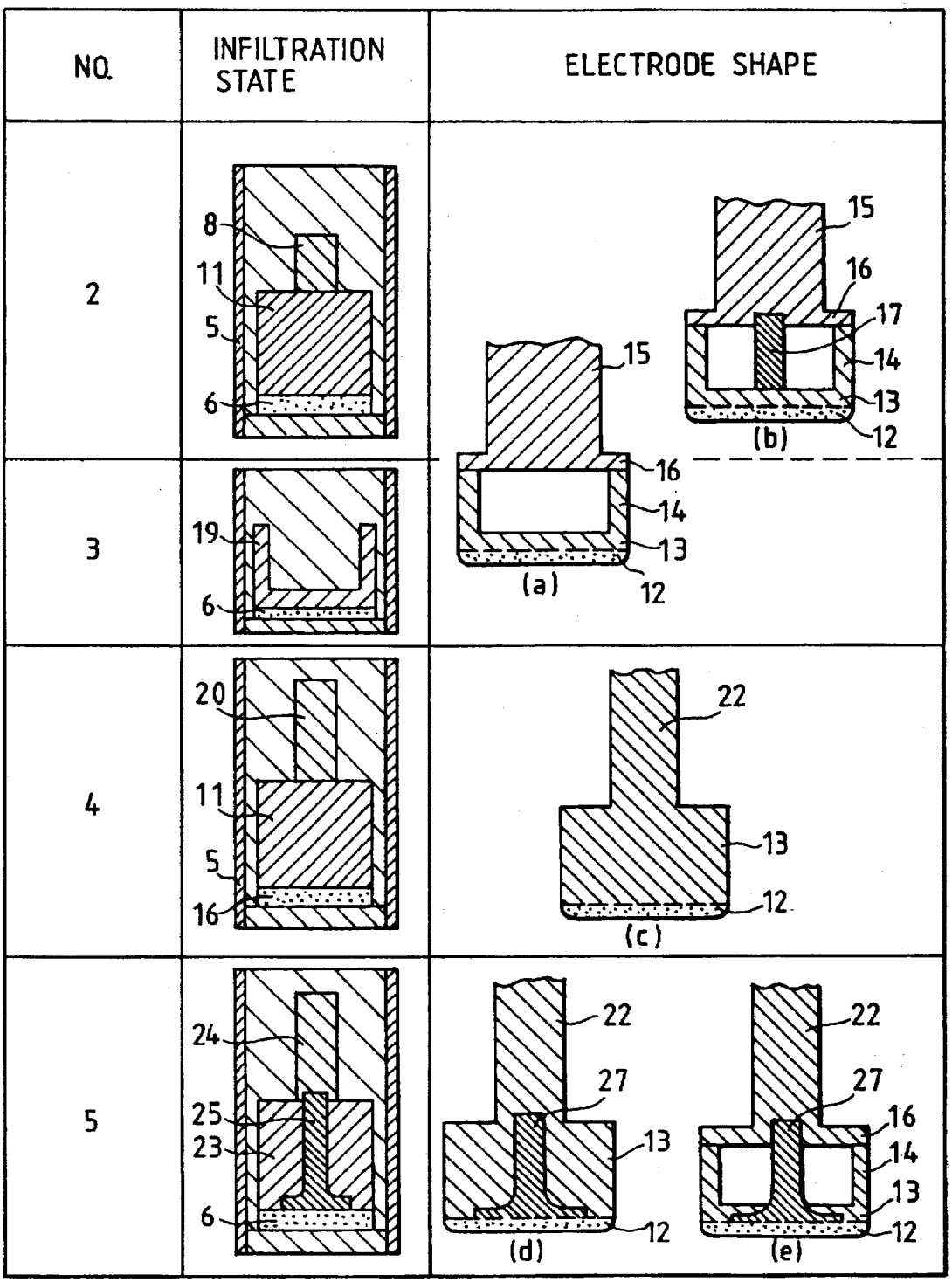
FIG. 3 is a sectional view showing relations between shapes of various electrodes and molds for producing them.

FIG. 3 shows infiltration states and electrode shapes obtained by using ingots after infiltration. Conditions for infiltration are almost the same as in Example 1.

In No. 2, the graphite vessel 5 used was 150 mm in length, the length of an arc electrode support and coil electrode member 11 used was 45 mm, and the infiltration holding time was set at 120 minutes. Other conditions were the same as in Example 1. From the resulting ingot there were produced electrodes of type (a) and type (b) as illustrated in FIG. 3. In type (a), an arc electrode 12, arc electrode support member 13 and coil electrode 14 are constituted as an integral structure, and an electrode rod 15 was bonded at 16 by soldering. Type (b) is the same as type (a) except that a reinforcing member 17 formed of pure Cu is provided at the center. The reinforcing member 17 is soldered to both the electrode support member 13 and the electrode rod 15.

No. 3 is different from No. 2 in that the shape of an arc electrode support and coil electrode member 19 is concave and that infiltration was performed in an excluded state of the infiltration Cu supply and feeder head member 8. From the ingot of No. 3 there was obtained the electrode shape of type (a).

No. 4 is different from No. 2 in that there was used an infiltration Cu supply and feeder head member 20 having a length of 100 mm and that the length of the graphite vessel 5 was changed to 200 mm. From the ingot of No. 4 there was produced an electrode of type (c). The type (c) electrode permits an integral electrode structure including an electrode rod 22 even without soldering. From the ingot of No. 4, not only the type (c) electrode but also type (a) and type (b) electrode structures can be produced by a cutting work.

No. 5 is different from No. 4 in that a trumpet-shaped iron core is inserted toward a sinter 26 through the center of an arc electrode support and coil electrode member 23 and that of an infiltration Cu supply and feeder head member 24. The melting point of the iron core is higher than that of Cu, and no limitation is placed on its shape. From the ingot of No. 5 there were produced electrodes of type (d) and type (e).

The type (d) electrode is of a shape with iron core 27 inserted in the center of the type (c) electrode, and the type (e) electrode is of a shape with iron core inserted in place of the reinforcing rod 17 of the type (b) electrode.

Measurement was made about changes between the dimensions of the ingots and the dimensions before infiltration. As a result, as to the dimensions of the arc electrode support and coil electrode members, there was scarcely recognized any difference between the states before infiltration and the ingot dimensions after infiltration. On the other hand, as to the feeder head members, the ingot size after infiltration was reduced to 10 mm relative to 25 mm before infiltration. Thus, the first condition for accomplishing the present invention is to obtain a double structure of the arc electrode support and coil electrode member and the infiltration Cu or Cu alloy supply and feeder head member.

For obtaining a desired ingot size, it is important to control the ingot cooling speed appropriately. In this case, it is necessary to increase the cooling speed for the ingot top rather than that for the ingot side face.

The second condition for accomplishing the present invention is to use ceramic particles large in specific heat and not reacting with molten Cu, e.g. alumina ($Al_2O_3$), as a heat retaining material which increases the cooling speed for the ingot top. In this case, if the ceramic particle diameter is too large or too small, the molten metal will flow out between ceramic particles, resulting in that the mold does not fulfill its function. An optimum particle diameter is in the range from 20 to 325 mesh. For the heat retaining purpose, it is necessary that ceramic particles be used at a thickness corresponding to two-thirds of a desired ingot diameter.

EXAMPLE 3

Table 1 shows analytical results on the amount of Cr in ingot at varying infiltration temperatures in the infiltrated state of No. 2 in Example 2, as well as analytical results on the composition of each ingot obtained in various compositions of the sinter 6 and the arc electrode support and coil electrode member 11. As to the composition of the infiltration Cu supply and feeder head member 8, no change was made.

Regarding No. 6 to No. 8, there are shown Cr contents in ingots obtained by varying the Cu infiltration temperature for Cr—5Cu of the sinter 6 and holding at those temperatures for 120 minutes. It is seen that the ingot composition at an infiltration temperature of 1,250° C. is a Cu alloy containing 1.65% of Cr.

Nos. 9, 10, 14, 15, 16 and 18 show elementary analysis results with respect to ingots obtained using Cu—Ag, Cu—Zr, Cu—Si and Cu—Be alloys as infiltration materials while using the same Cr—5 Cu composition of the sinter 6. It is seen that each ingot is a ternary Cu alloy containing about 0.6% of Cr.

Nos. 11, 12, 13 and 17 show elementary analysis results with respect to ingots obtained using sinters 6 of Cr—5 Cu and further containing V, Nb, V—Nb and W, respectively, as additional components and using the same pure Cu composition of the members 7, 8. It is seen that each ingot is a Cu alloy containing not more than 0.02% of V, Nb or W and about 1.0% of Cr.

(Comparative Example 2). On the other hand, No. 6 exhibits a stable interface strength of 24 to 25 kg/mm$^2$, and its test piece proved to include no defect. In the working examples of the present invention it is impossible to measure an electric resistance value including interface. In the arc electrode of Comparative Example 1, the mating material is pure Cu, while No. 6 according to the present invention uses a Cu alloy containing about 0.62% of Cr as the mating material; nevertheless, the specific resistance value of 1.95 μΩcm is lower than that in Comparative Example 1 because there is no interface. From this point it is seen that the resistance value of the soldered interface according to the prior art is very large.

On the other hand, as to the pure Cu in Comparative Example 2, its yield strength of 4 to 5 kg/mm$^2$ is very low relative to its maximum strength value of 22 to 23 kg/mm$^2$. It is seen that if such pure Cu is used as the material of an arc electrode support member or a coil electrode, there will occur deformation under an impulsive load with the lapse of time. The electric resistance values of Nos. 7 to 18 which are Cu alloys each containing Cr or Ag, V, Nb, Zr, Si, W or Be are about 1.5 to 2.0 times as large as that of the annealed pure Cu and they are not larger than about half of the electric

TABLE 1

| | Composition (wt %) | | | | Results of Analysis (wt %) | | | | | | | |
|---|---|---|---|---|---|---|---|---|---|---|---|---|
| No. | Sinter | Arc Electrode Material | Infiltration Material | Infiltration Temperature | Cr | Ag | V | Nb | Zr | Si | W | Be |
| 6 | Cr-5Cu | 61Cr-39Cu | Cu | 1150 | 0.62 | — | — | — | — | — | — | — |
| 7 | Cr-5Cu | 61.3Cr-38.7 | Cu | 1200 | 0.98 | — | — | — | — | — | — | — |
| 8 | Cr-5Cu | 60Cr-40Cu | Cu | 1250 | 1.65 | — | — | — | — | — | — | — |
| 9 | Cr-5Cu | 60.7Cr-39.2Cu-0.002Ag | Cu-0.5Ag | 1150 | 0.67 | 0.46 | — | — | — | — | — | — |
| 10 | Cr-5Cu | 60.2Cr-39.7Cu-0.004Ag | Cu-1.0Ag | 1150 | 0.60 | 0.97 | — | — | — | — | — | — |
| 11 | Cr-5Cu-3V | 60.7Cr-37.4Cu-1.90V | Cu | 1200 | 0.92 | — | 0.02 | — | — | — | — | — |
| 12 | Cr-5Cu-3Nb | 61.0Cr-37.1Cu-1.91Nb | Cu | 1200 | 0.90 | — | — | 0.01 | — | — | — | — |
| 13 | Cr-5Cu-3V-3Nb | 59.7Cr-36.49Cu-1.87V-1.94Nb | Cu | 1200 | 0.97 | — | 0.01 | 0.01 | — | — | — | — |
| 14 | Cr-5Cu | 61.2Cr-38.8Cu-0.003Zr | Cu-0.5Zr | 1150 | 0.68 | — | — | — | 0.41 | — | — | — |
| 15 | Cr-5Cu | 60.8Cr-39.2Cu-0.005Zr | Cu-0.1Zr | 1150 | 0.64 | — | — | — | 0.81 | — | — | — |
| 16 | Cr-5Cu | 61.2Cr-38.8Cu-0.004Si | Cu-0.5Si | 1150 | 0.61 | — | — | — | — | 0.39 | — | — |
| 17 | Cr-5Cu-5W | 58.1Cr-38.7Cu-3.2W | Cu | 1200 | 0.90 | — | — | — | — | — | 0.01 | — |
| 18 | Cr-5Cu | 60.7Cr-39.3Cu | Cu-0.1Be | 1200 | 0.89 | — | — | — | — | — | — | 0.08 |

Table 2 shows results (Comparative Example 1) obtained by measuring electric resistance and strength of a bonded portion by soldering as a conventional method (using Ni-based solder in vacuum at 800° C.) between an arc electrode (59 wt % Cr—41 wt % Cu) and pure Cu, an electric resistance value (Comparative Example 2) of pure copper annealed at 800° C., and electric resistance and strength measurement results for the ingots obtained in Nos. 6 to 18. The measurement of electric resistance was conducted using an Amsler tension tester in accordance with a four-point resistance measuring method.

The interface strength of the soldered portion by the conventional method (Comparative Example 1) greatly varies from 22 to 12 kg/mm$^2$, and a defective soldered part was found in the test piece of 12 kg/mm$^2$ in strength. The electric resistance value of 4.82 μΩcm, including the interfacial part, is about three to four times higher than that of pure copper resistance value of the soldered interface according to the prior art. Although the maximum strength values of Nos. 7 to 18, which are 22 to 25 kg/mm$^2$, are not so greatly different from that of pure Cu, their 0.2% yield strength values, which are 10 to 14 kg/mm$^2$, are twice that of pure Cu, thus showing improvement in strength.

As set forth above, the arc electrode support members, coil electrodes and electrode rods according to the present invention, which are each formed of a Cu alloy containing Cr or any of Ag, V, Nb, Zr, Si, W and Be are not deformed even under repeated impulsive loads imposed thereon at the time of opening and closing of the electrodes, whereby it is made possible to prevent the fusion trouble caused by deformation and hence possible to improve reliability fan safety.

TABLE 2

| | Electric Resistance value (μΩ · cm) | Results of Tension Test (kg/mm²) $\sigma_{0.2}$ (0.2% Yield Strength) | $\sigma_B$ (Maximum Strength) |
|---|---|---|---|
| Comparative Example 1 | 4.82 (interface) | 4~5 | — |
| Comparative Example 2 | 1.73 | 4~5 | — |
| No. 6 | 1.95 | 9~10 | 20~21 |
| No. 7 | 2.13 | 10~11 | 23~22 |
| No. 8 | 2.54 | 11~12 | 23~22 |
| No. 9 | 2.20 | 12~13 | 23~22 |
| No. 10 | 2.25 | 12~13 | 23~22 |
| No. 11 | 2.24 | 11~12 | 22~21 |
| No. 12 | 2.22 | 11~12 | 22~21 |
| No. 13 | 2.28 | 11~12 | 22~21 |
| No. 14 | 2.31 | 12~13 | 23~22 |
| No. 15 | 2.42 | 12~13 | 23~22 |
| No. 16 | 2.72 | 12~13 | 23~22 |
| No. 17 | 2.14 | 11~12 | 23~22 |
| No. 18 | 2.24 | 12~13 | 24~23 |

Figure 4:
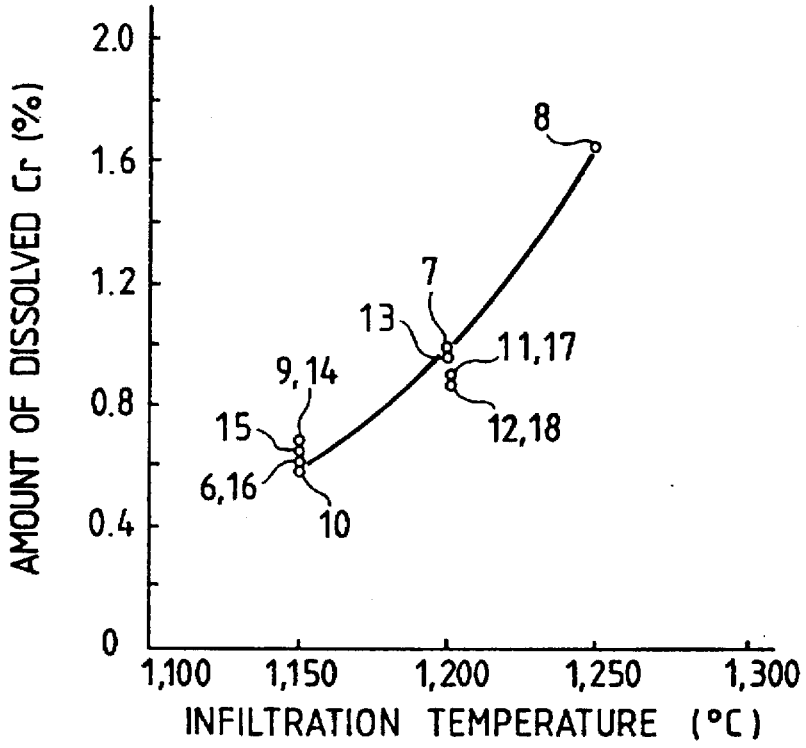
FIG. 4 is a diagram showing a relation between the amount of Cr dissolved and infiltration temperatures.

FIG. 4 is a diagram showing a relation between the filtration temperature and the amount of Cr dissolved into an infiltration material from a porous Cr sinter. As illustrated therein, the amount of Cr dissolved into the infiltration material can be increased by raising the infiltration temperature. Further, a desired amount of Cr can be obtained by suitably adjusting the infiltration temperature.

Figure 5:
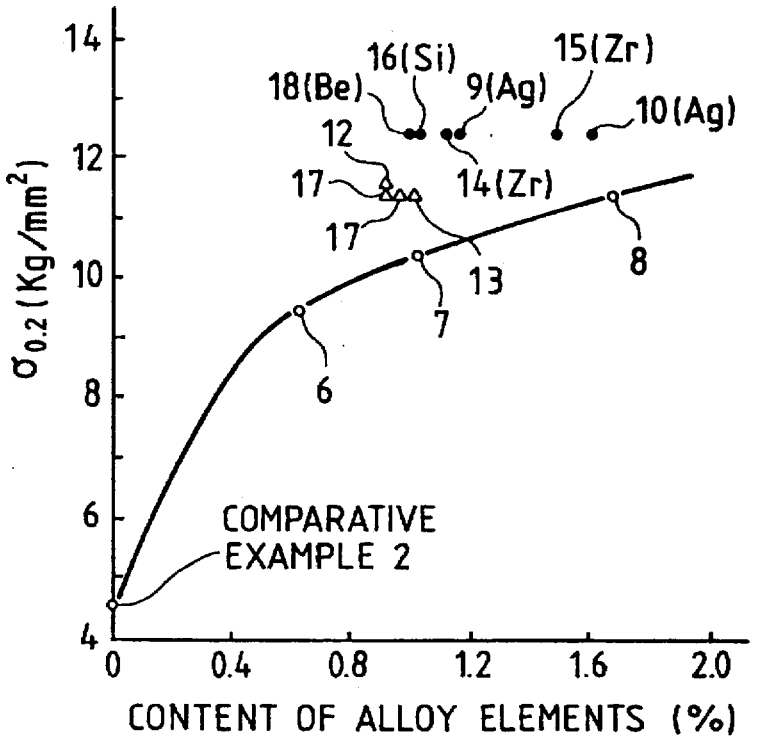
FIG. 5 is a diagram showing a relation between 0.2% yield strength and the amount of alloy elements dissolved.

FIG. 5 is a diagram showing a relation between the content of alloy elements in Cu and 0.2% yield strength. From the same figure it is apparent that the yield strength is enhanced by increasing the content of Cr alone in Cu—Cr alloy and also by increasing the content of both Cr and other element(s) in Cu—Cr-other element(s) alloys. In comparison with the Cu alloy containing Cr alone, those containing both Cr and other elements exhibit a higher strength even in the same total content. If the contents of Ag, Zr, Si, Be and each of Nb, V and W, are set at 0.1%, 0.1%, 0.1%, 0.05% and 0.01% or higher, there will be obtained an yield strength of 10 kg/mm² or higher.

Figure 6:
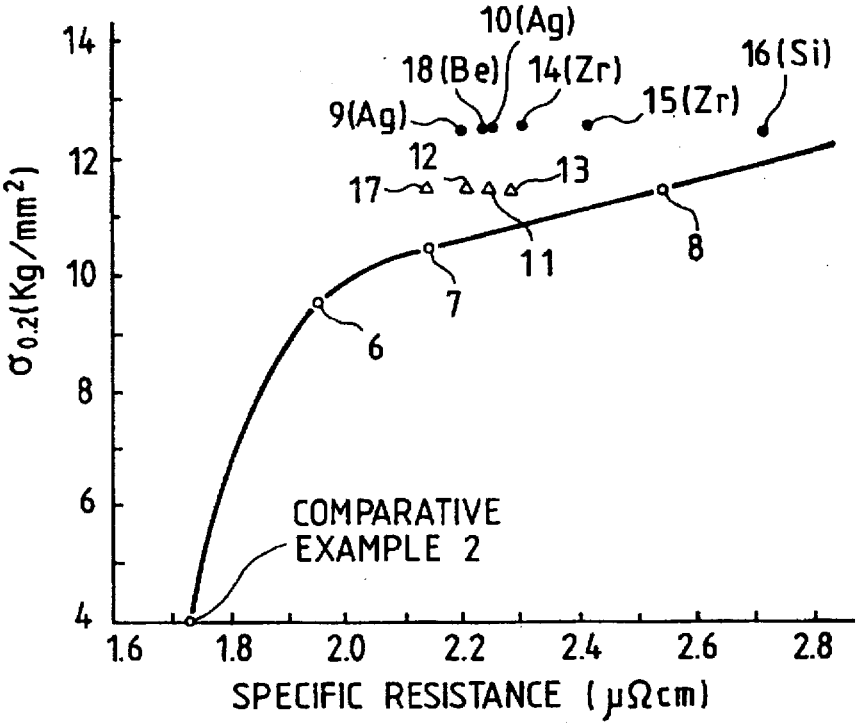
FIG. 6 is a diagram showing a relation between 0.2% yield strength and specific resistance.

FIG. 6 is a diagram showing 0.2% yield strength vs. specific resistance. As illustrated therein, with increase in the total amount of alloying elements into Cu, not only the strength is improved but also the specific resistance increases, so it is seen that in order to suppress the increase of specific resistance and attain an improvement of strength there should be added other element(s) in addition to Cr. Particularly, the other elements than Si are low in specific resistance and afford a high strength. Preferably, the 0.2% yield strength is set at 10 kg/mm² or larger and specific resistance at 1.9 to 2.8 μΩcm.

Figure 7:
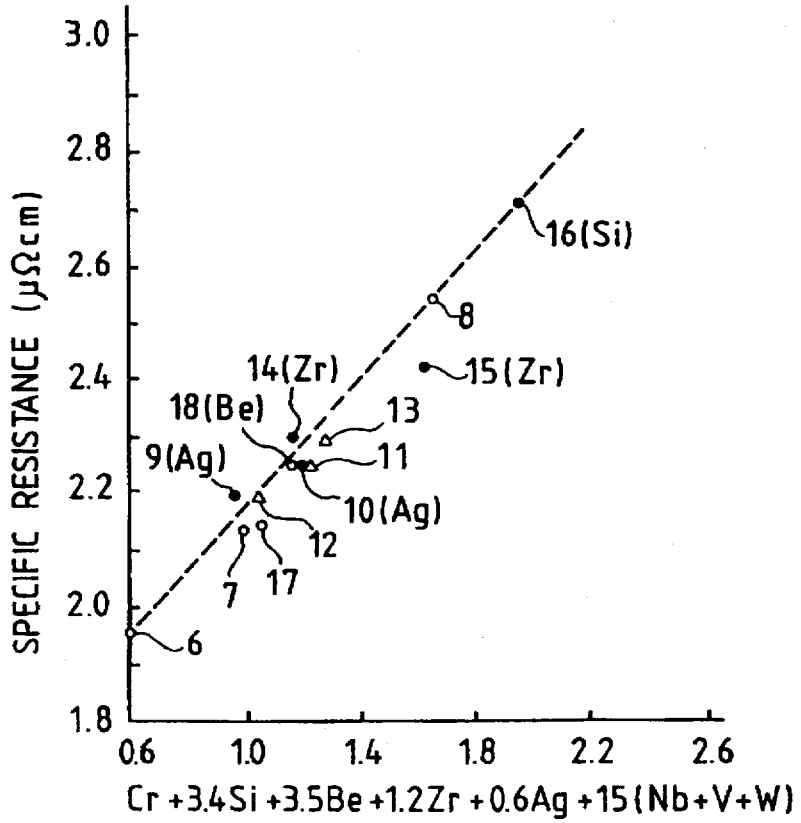
FIG. 7 is a diagram showing specific resistance and alloy elements.

FIG. 7 is a diagram showing a relation between the amounts of Cr, Si, Be, Zr, Ag, Nb, V and W and specific resistance. The specific resistance is increased by the addition of alloying elements, but by making the specific resistance of the electrode support member and coil electrode as low as possible, the electrode temperature in a current flowing state can be kept low, and since it is necessary to lower through the electrode rod the heat of arc created upon circuit breaking, it is necessary to make that heat conductivity high, so it is possible to maintain the thermal conductivity high. In this example, a desired specific resistance can be obtained as an approximate value in the figure. In the case of using Cr as an arc electrode, it is desirable that the upper limits of contents of Si, Be, Zr, Ag and each of Nb, V and W be set at 0.5%, 0.5%, 1.5%, 2.5% and 0.1%, respectively, taking the amount of Cr infiltrated into consideration. A preferred value of specific resistance is not higher than 3.0 μΩcm.

EXAMPLE 4

Figure 8:
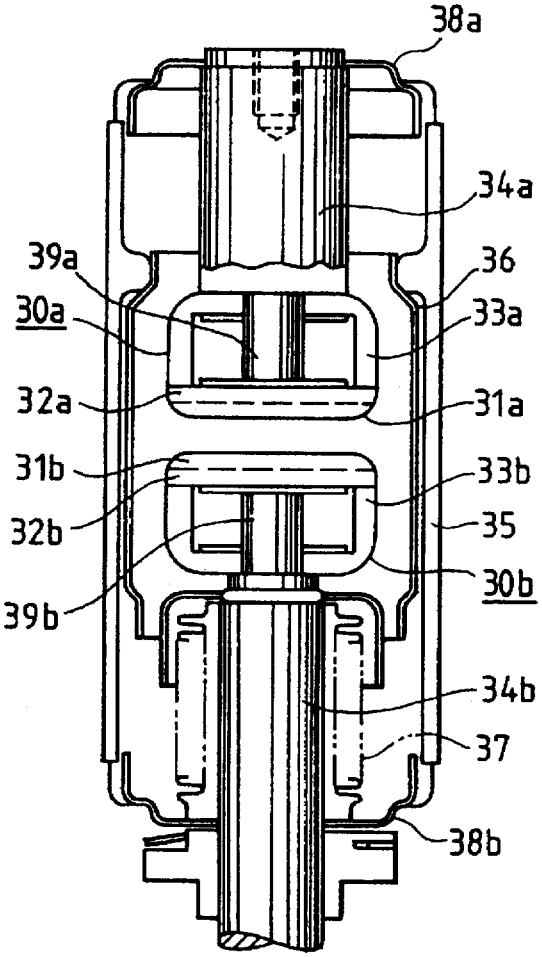
FIG. 8 is a sectional view of a vacuum valve according to the present invention.

FIG. 8 is a sectional view of a vacuum valve using arc electrodes according to the present invention. In the same figure, a pair of upper and lower end plates 38*a*, 38*b* are provided in upper and lower openings, respectively, of an insulating cylinder 35 formed of an insulating material to constitute a vacuum vessel which defines a vacuum chamber. A fixed electroconductive rod 34*a* which constitutes a part of a fixed electrode 30*a* is suspended from a middle portion of the upper end plate 38*a*, and a vertical magnetic field generating coil 33*a* and an arc electrode 31*a* are attached to the fixed electroconductive rod 34*a*. On the other hand, a movable electroconductive rod 34*b* which constitutes a part of a movable electrode 30*b* is mounted vertically movably to a middle portion of the lower end plate 38*b* positioned just under the fixed electrode 30*a*, and a vertical magnetic field generating coil 33*b* and an arc electrode 31*b* which are of the same shape and size as the coil 33*a* and arc electrode 31*b*, respectively, are attached to the movable electroconductive rod 34*b* in such a manner that the arc electrode 31*b* on the movable electrode 30*b* side moves into contact with and away from the arc electrode 31*a* on the fixed electrode 30*a* side. Inside the lower end plate 38*b* located around the movable electroconductive rod 34*b* is disposed a metallic bellows 37 for expansion and contraction and in a covering relation to the rod 34*b*. A shield member 36 as a metallic cylinder is disposed around both arc electrodes and is held in place by the insulating cylinder 35. The shield member 36 is constituted so as not to impair the insulating property of the insulating cylinder 1.

Further, the arc electrodes 31*a* and 31*b* are integrally fixed to arc electrode support members 32*a* and 32*b*, respectively, which have been obtained by the foregoing infiltration, and these integral structures are soldered to the vertical magnetic field generating coils 33*a* and 33*b*, respectively, while being reinforced by reinforcing members 39*a* and 39*b* formed of pure iron. As the material of the reinforcing members 39*a* and 39*b* there may be used an austenitic stainless steel. And as the material of the insulating cylinder 35 there is used sintered glass or ceramic material. The insulating cylinder 35 is soldered to the metallic end plates 38*a* and 38*b* through an alloy plate whose thermal expansion coefficient is close to that of glass or ceramic material, e.g. Kovar, and is held in a high vacuum of $10^{-6}$ mmHg or less.

The fixed electroconductive rod 34*a* is connected to a terminal and serves as an electric current path. An exhaust pipe (not shown) is attached to the upper end plate 38*a*, and for exhaust, it is brought into connection with a vacuum pump. A getter is provided for absorbing a very small amount of gas when evolved in the interior of the vacuum vessel and thereby maintaining the vacuum. The shield member 36 functions to deposit for cooling the metal vapor on the main electrode surface which vapor is generated by arc. The deposited metal fulfills a vacuum holding function corresponding to the getter function.

Figure 9:
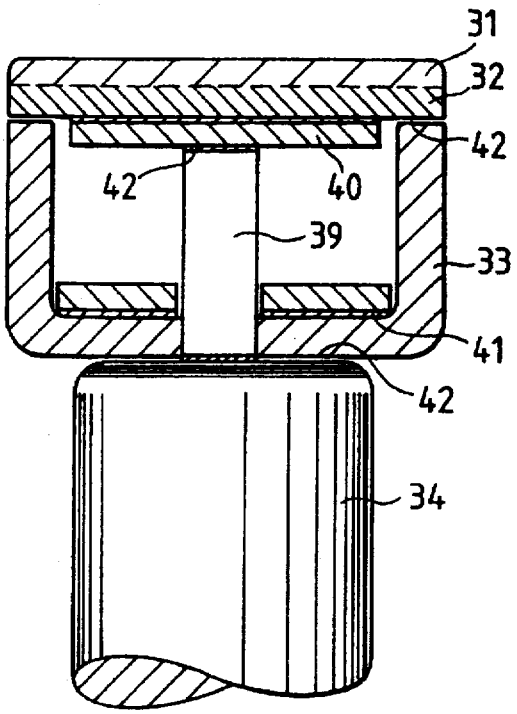
FIG. 9 is a sectional view of electrodes for the vacuum valve.

FIG. 9 is a sectional view showing the details of electrode. Both fixed electrode and movable electrode are almost the same in structure. An arc electrode 31 is made integral by infiltration of Cu with the electrode support member shown in Example 1. This integral structure is subjected to a cutting work as in the figure. A reinforcing plate 40 made of a non-magnetic, austenitic stainless steel is soldered to the electrode support member indicated at 32 and a like plate is also soldered to a coil electrode 33. The coil electrode 33, which is formed of pure copper, was soldered to both electroconductive rod 34 and arc electrode using a solder lower in melting point than the solder used above.

The arc electrode support member 32 used in this example was formed by infiltration of pure copper. The amount of Cr to the support member 32, which differs depending on the infiltration temperature as mentioned previously, is determined in consideration of required strength and electric resistance. By the deposition of a compound through heat treatment it is made possible to lower the electric resistance without deterioration of strength. In this example, there was formed a deposit of Cr by allowing to cool down to 900° C. after infiltration of pure copper, then cooling slowly from that temperature to a temperature of 700° to 800° C. over a period of 3 hours and further cooling slowly to a temperature of 600° to 700° C. over a 2 hour period.

Figure 10:
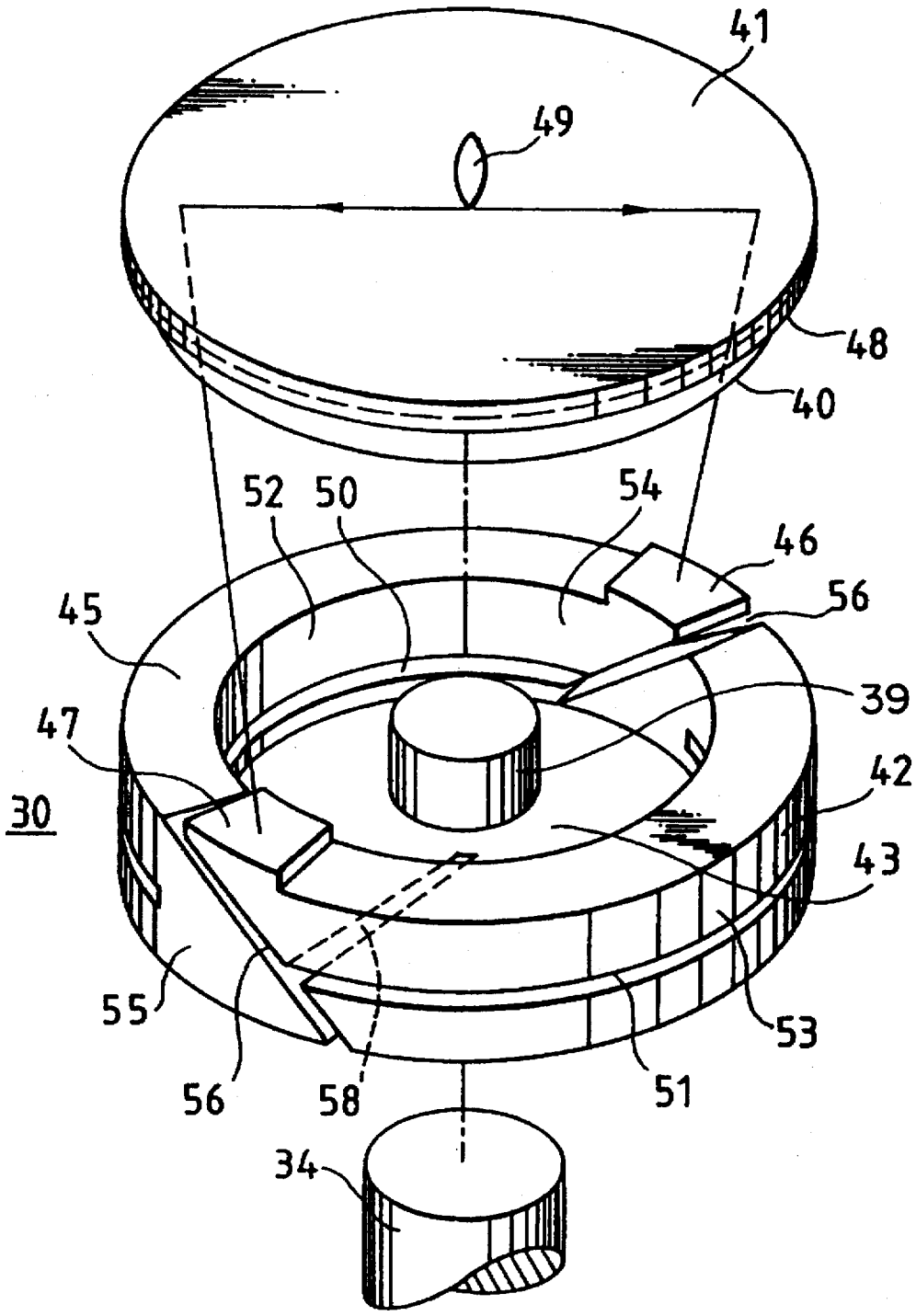
FIG. 10 is a perspective view of the electrodes for the vacuum valve.

FIG. 10 is a perspective view showing a state of connection between the arc electrode portion and the coil electrode 33 in this example. As the movable electroconductive rod 34 moves axially, the movable electrode **30*b* comes into electrical contact with or away from the fixed electrode 30*a*, whereupon arc current 49** is generated between both electrodes to create a metallic vapor.

The metallic vapor adheres to the intermediate shield member 36 and at the same time it is dispensed by the axial magnetic field of the cylindrical coil electrode 33, then is extinguished. Although in this example the cylindrical coil electrode 33 is mounted in each of the fixed electrode **30*a* and movable electrode 30*b***, it may be provided at least on one side.

The cylindrical coil electrode 33, which is attached to the back of a main electrode 41, is constituted by a cylindrical portion 42 having a bottom 43 at one end and an opening at the opposite end. The reinforcing member 39 is formed of a high resistance member, e.g. Fe or stainless steel, and is disposed between the bottom 43 and the main electrode 41. Two protrusions 46 and 47 are formed on an end face of the opening of the cylindrical portion 42 on the main electrode side, the main electrode 41 being electrically connected to the protrusions 46 and 47. The protrusions may be formed on the main electrode. In the semi-arcuate cylindrical portion 42 between one protrusion 46 and the other protrusion 47 there are formed arcuate slits 50 and 51 to provide two arcuate current paths 52 and 53. One ends, e.g. input ends 54, of the current paths 52 and 53 are connected to the protrusions 46 and 47, while the other ends thereof, e.g. output ends 55, are connected to the electroconductive rod 34 through the bottom 43. Inclined slits 56 are formed between the input and output ends 54, 55 of the cylindrical portion 42 where both ends lap each other. One end of each inclined slit 56 is in communication with one arcuate slit end, while the other end thereof is formed by cutting in the portion between the one slit end and the portion of the opening end face 45 opposed thereto. Thus, the input 54 and the output end 55 are electrically divided from each other through the inclined slits 56. In the output end 55 is formed a slit 58 extending up to a position near the rod in the bottom 43 to prevent the generation of an eddy current under an axial magnetic field H.

Next, when the movable electrode **30*b* is moved away from the fixed electrode 30*a* to break the current flow, an arc current 49 is formed between both electrodes. As indicated with arrows, the arc current 49 flows from the protrusions 46 and 47, then through the input end 54 and the current paths 52, 53, further through the bottom 43 from the output end 55 and flows into the electroconductive rod 34**.

The electric current flowing through the current paths 52, 53 and the lapped input and output ends 54, 55 forms one turn through the above electric current route. The axial magnetic field H generated by such one turn of electric current is applied uniformly to the whole surface of the main electrode and the arc current 49 is dispersed uniformly throughout the entire main electrode surface, whereby not only the cut-off performance can be improved, but also the whole surface of the main electrode can be utilized effectively, thus permitting so much reduction in size of the vacuum circuit breaker.

Figure 11:
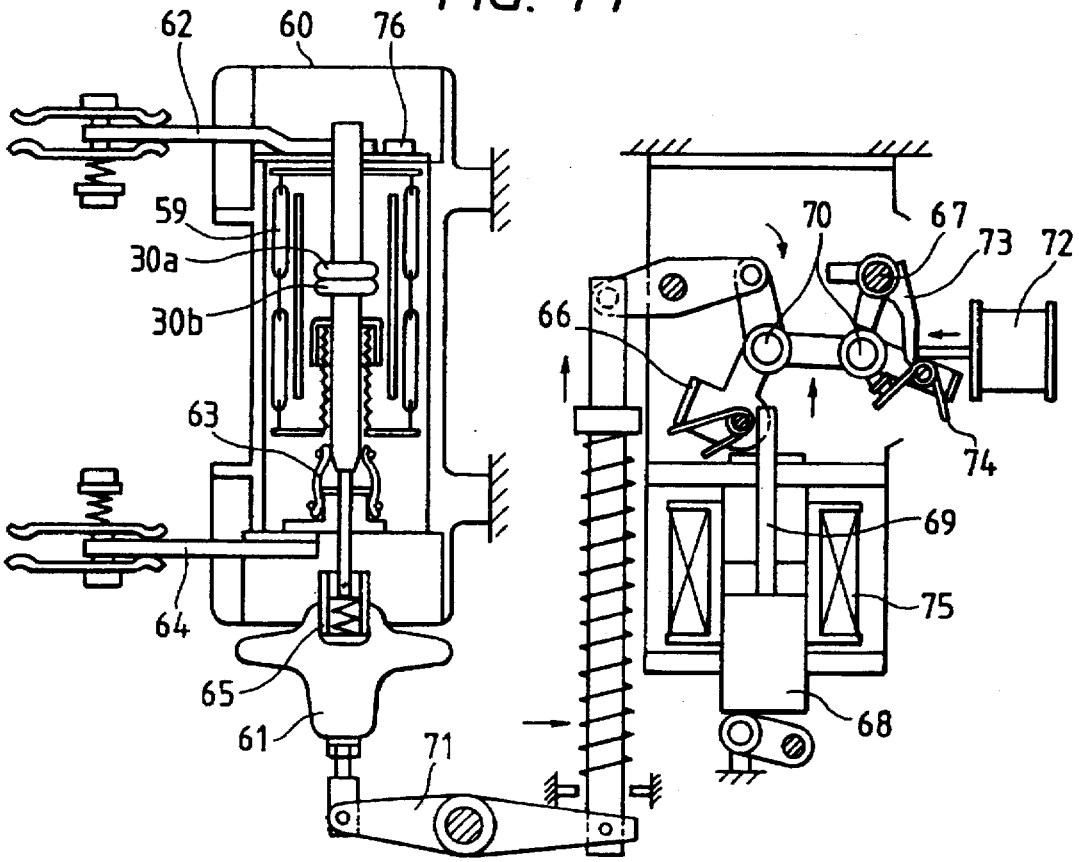
FIG. 11 is a view showing the construction of the whole of a vacuum circuit breaker according to the present invention.

FIG. 11 is a construction diagram of a vacuum circuit breaker according to the present invention, showing a vacuum valve 59 and an operating machine for the vacuum valve.

This circuit breaker is of a small-sized, light-weight structure wherein an operating mechanism is disposed in front and three sets of three-phase combined type anti-tracking epoxy cylinders 60.

Each phase end is a horizontal draw-out type supported horizontally by an epoxy resin cylinder and a vacuum valve supporting plate. The vacuum valve is opened and closed by the operating mechanism through an insulated operating rod 61.

The operating mechanism is an electromagnetically operated type mechanically trippable mechanism having a simple, small-sized and light-weight structure. There is induced little impact because the opening/closing stroke is short and the mass of the movable portion is small. On the front side of its body there are arranged manual connection type secondary terminals, open/close indicator, meter for indicating the number of times of operation, manual tripping button, manual closing device, draw-out device and interlock lever.

(a) Closed State

This state indicates a closed state of the circuit breaker, in which an electric current flows through upper terminal 62, main electrode 30, current collector 63 and lower terminal 64. A contact force between main electrodes is ensured by means of a contact spring 65 attached to the insulated operating rod 61.

The said contact force, the biasing force of a quick-break spring and an electromagnetic force induced by short-circuit current are ensured by a support lever 66 and a prop 67. Upon energization of a closing coil in an open circuit condition, a plunger 68 pushes up a roller 70 through a knocking rod 69, causing a main lever 71 to turn to close the contacts, then this state is held by the support lever 66.

(b) Trippable State

With the electrode parting motion, the movable main electrode is moved downward and an arc is formed upon separation of the fixed and movable main electrodes.

The arc is extinguished in a short time by a vigorous diffusing action between it and a high dielectric strength in vacuum.

When a tripping coil 72 is energized, a tripping lever 73 disengages the prop 67 and the main lever 71 is turned by virtue of the quick-break spring to open the main electrodes. This operation is performed completely independently of whether the closing motion is performed or not. Thus, this is a mechanically trippable operation.

(c) Open State

After opening of the main electrodes, the links revert to the original state under the action of a reset spring 74 and at the same time the prop 67 assumes its engaged state. If a closing coil 75 is energized in this state, there is obtained the closed state (a). Numeral 76 denotes an exhaust duct.

The vacuum breaker exhibits a high cut-off performance in a high vacuum by utilizing the high dielectric strength of the vacuum and the high-speed diffusing action of arc. On the other hand, in the case of opening and closing a no-load motor or transformer, an electric current is cut off before it reaches zero, resulting in that a so-called chopped current is created and there sometimes is generated a switching surge voltage proportional to the product of the said current and surge impedance. Therefore, when a 3 kV transformer or a 3 kV or 6 kV rotating machine is to be opened or closed directly by the vacuum circuit breaker, it is necessary to connect a surge absorber to the circuit to suppress the surge voltage and thereby protect the machine. As the surge absorber there usually is employed a capacitor, provided a non-linear resistor of ZnO is also employable depending on an impulse wave withstand voltage value of the load.

According to this example described above, it is possible to cut off 7.2 kV, 31.5 kA, at a pressure of 150 kg and a breaking speed of 0.93 m/sec.

EXAMPLE 5

Figure 12:
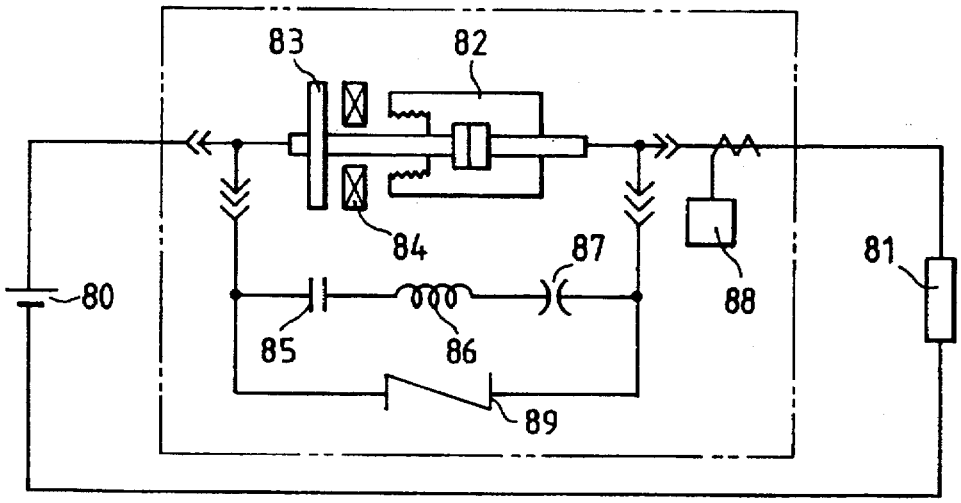
FIG. 12 is a circuit diagram using a DC vacuum circuit breaker.

FIG. 12 is a diagram showing a main circuit configuration for interrupting a DC circuit by using the same vacuum valve as that in Example 4. In the same figure, the numeral 80 denotes a DC power source, numeral 81 denotes a DC load, 82 a vacuum valve, 83 a short ring, 84 an electromagnetic repulsion coil, 85 a commutation capacitor, 86 a commutating reactor, 87 a trigger gap, 88 a static overcurrent tripper and 89 a non-linear resistor of ZnO.

In this example there are obtained the following features.

(1) Since the circuit breaking operation causes not arc to be formed in air, noise is not generated and there is attained an outstanding accident preventing effect.

(2) Because of a short contact parting time (about 1 ms), it is possible to cut off an accident current of a rush rate higher than a rated value and hence possible to minimize a cut-off current.

(3) The use of the vacuum valve permits interruption of a capacitor discharge current of a high frequency and the arcing time is extremely short (about 0.5 ms), thus making it possible to diminish contact erosion.

(4) By the adoption of a static overcurrent tripper, the current scale can be set with a high accuracy and there is no secular change.

(5) By the adoption of a spring type motor spring operating device, the operating current is greatly decreased and the holding current is no longer necessary.

(6) Since the occupied area is about one-fourth of that in the prior art, it is possible to reduce the substation space.

EXAMPLE 6

Figure 13A:
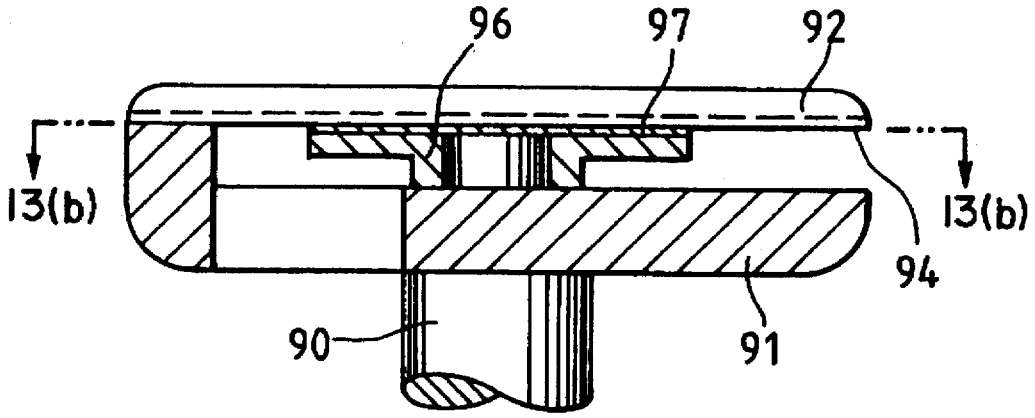
FIG. 13 comprises a front section view and a sectional view taken along the line 13(*b*)—13(*b*), showing the structure of another example of vacuum valve electrodes according to the present invention.
Figure 13B:
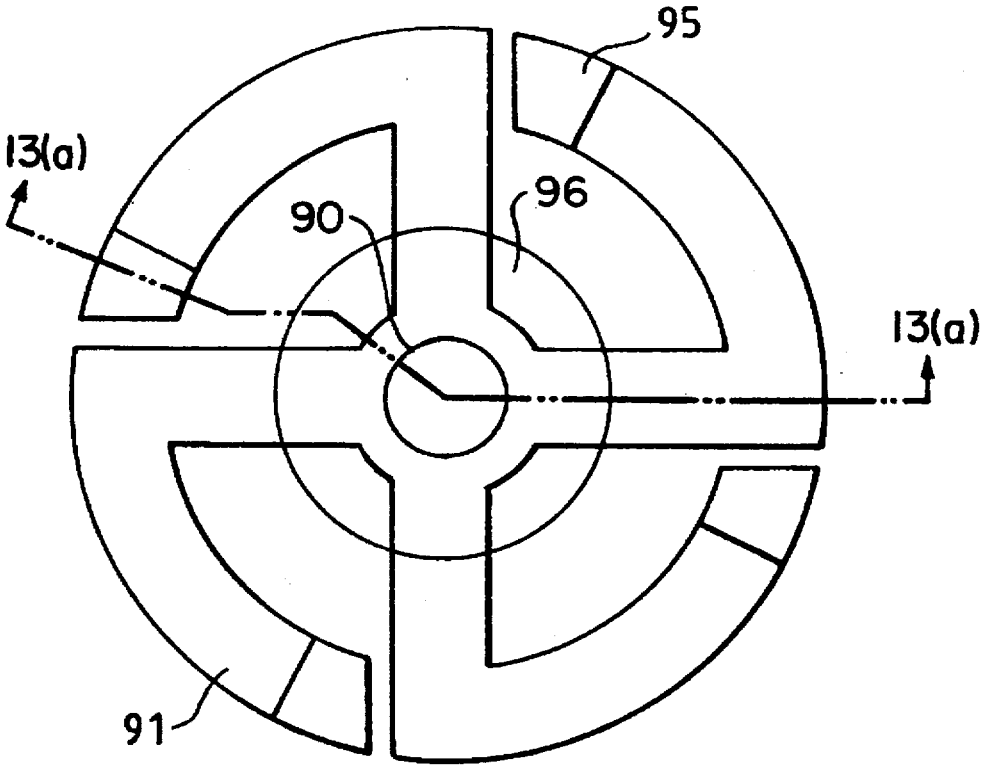

FIGS. 13(*a*) and 13(*b*) sectional views showing another electrode structure, in which FIG. 13(*a*) is a front sectional view taken along the line 13(*a*)—13(*a*) of FIG. 13(*b*) and FIG. 13(*b*) is a sectional view taken along line 13(*b*)—13(*b*) of FIG. 13(*a*).

In this example, like Example 1, a main electrode 92 comprises an arc electrode as a surface electrode formed by a porous Cu—Cr sinter and an arc electrode support member formed thereon by infiltration of pure copper, with a vertical magnetic field generating coil electrode 91 being soldered to the main electrode 92. Further, reinforcement is made by soldering, by using solder 97 of a reinforcing member 96 of pure iron or stainless steel. Numeral 90 denotes an electroconductive rod. The main electrode 92 is soldered at a projecting portion 95 of the coil electrode 91.

EXAMPLE 7

Figure 14A:
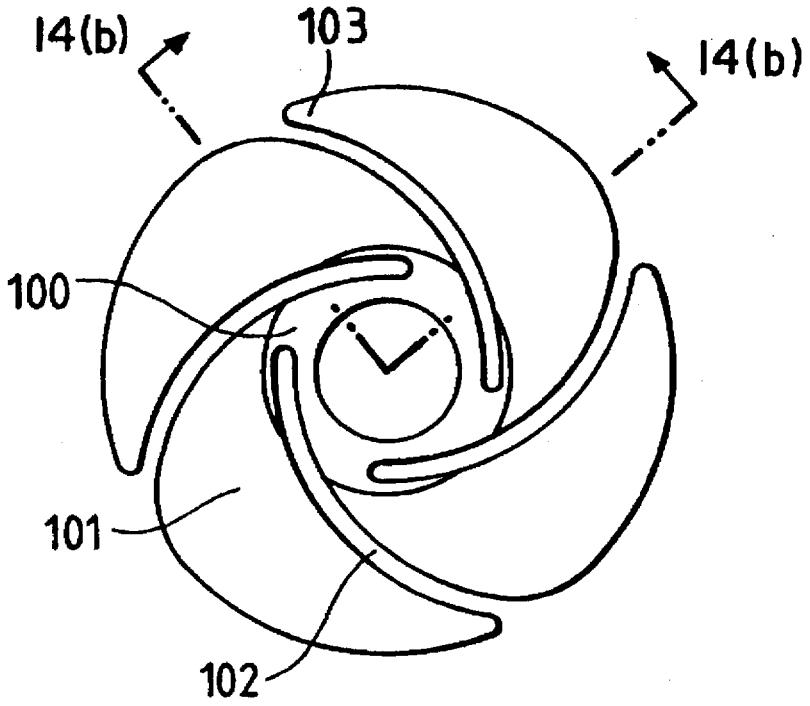
FIG. 14 comprises a plan view and a sectional view taken along the line 14(*b*)—14(*b*), showing the structure of a further example of vacuum valve electrodes according to the present invention.
Figure 14B:
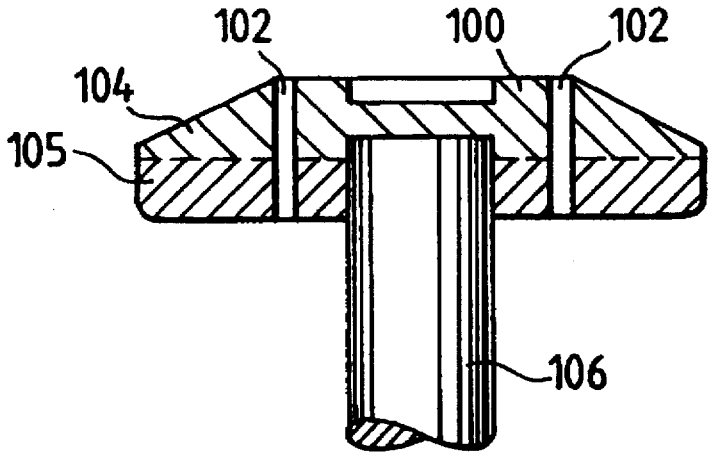

FIGS. 14(*a*) and 14(*b*) illustrate a further example of an electrode structure, in which FIG. 14(*a*) is a plan view and FIG. 14(*b*) is a sectional view taken on line 14(*b*)—14(*b*) of FIG. 14(*a*).

Spiral electrodes of clockwise and counterclockwise windings overlap each other when viewed from opposed sides. Numeral 100 is designated a contact portion of arc electrodes capable of contacting and parting with respect to each other. Numeral 101 denotes an arc runner. Spiral grooves 102 have respective terminal ends at the contact portion 100 to divide the arc runners 101. Each arc runner is in contact at its distal end 103 with the electrode outer periphery. The number of the arc runners to be used is optional. The electrodes are each formed as an integral structure of arc electrode 104 and arc electrode support portion 105 by infiltration of copper using Cu—Cr (copper-chromium) alloy for example. The grooves 102 can be formed by machining.

Though not shown, as an electrode structure in a vacuum circuit breaker for a short-circuit current of 12.5 kA or less there is used a simple flat plate-like structure free of spiral grooves 102. The flat plate-like structure has a contact portion, a tapered portion corresponding to the arc runner and an electrode outer peripheral portion, which are formed as an integral body.

The main electrode is connected through the soldered electrode rod to an electrode terminal provided outside the vacuum vessel.

Description is now directed to the operation for breaking a short-circuit current of 12.5 to 50 kA in an AC circuit, using the spiral electrodes shown in FIG. 14. First, as a pair of electrodes begin to part from each other, an arc is formed from the contact portion of main electrodes. With the lapse of time from this contact parting point, the arc between the electrodes shifts from the contact portion 100 to the arc runner distal ends 103 through arc runners 101. At this time, the characteristic of the spiral electrode structure causes a radial magnetic field to be formed in the electrode space, which magnetic field is called a lateral magnetic field because it is orthogonal to the arcing direction. The art shift on electrode is accelerated by a driving effect induced by such lateral magnetic field, thereby preventing non-uniform erosion of the electrode.

According to the present invention, as set forth above, in a vacuum circuit breaker having a fixed electrode and a movable electrode each comprising an arc electrode, an arc electrode support member and a coil electrode contiguous to the arc electrode support member, the arc electrode and the arc electrode support member, preferably the two and the coil electrode, are formed as an integral structure by melting, not by bonding, and the arc support member and the coil electrode are constructed of a Cu alloy containing 0.01–2.5 wt % of Cr, Ag, V, Nb, Zr, Si, W and/or Be, so it is possible to reduce the number of machining and assembling steps required in the soldering of the components and prevent breakage or drop-out of the electrodes caused by poor soldering. Besides, since the arc electrode and coil electrode are improved in strength, it is possible to prevent the fusion trouble based on electrode deformations. Consequently, it is possible to provide a highly reliable and safe vacuum circuit breaker as well as a vacuum valve and an electric contact for use therein.

What is claimed is:

1. A method of joining an electrode to an electrode support member to form an electric contact, comprising the steps of:

forming a porous sintered body of refractory metals, the porous sintered body representing an electrode;

setting the porous sintered body along with a highly electroconductive metal into a mold having an inner face shaped as an electric contact, the highly electroconductive metal representing an electrode support member;

heating the mold in order to melt the highly electroconductive metal to permit infiltration into the porous sintered body;

cooling the mold to solidify the highly electroconductive metal so as to join the electrode and the electrode support member.

2. The method according to claim 1, wherein the mold comprises ceramic powder which does not react with the highly electroconductive metal.

3. The method according to claim 2, wherein the ceramic powder has a grain size within the range of 25 to 325 mesh.

4. The method according to claim 1, further comprising a heat treating step performed after the cooling step, said heat treating step being performed to hold the electrode and electrode support member at a predetermined temperature to precipitate supersaturatedly dissolved metal or intermediate compound in the highly electroconductive metal.

5. A method according to claim 1, wherein said electrode and electrode support member form an electric contact which is one of a fixed electrode and a movable electrode of a vacuum valve.

6. A method according to claim 1, further comprising the step of forming a vertical magnetic field generating coil by shaping said highly electroconductive metal remaining, after the infiltration into said porous sintered body, into said electrode support member and said vertical magnetic field generating coil.

7. A method according to claim 4, wherein said electric contact is one of a fixed electrode and a movable electrode in a vacuum valve.

8. A method according to claim 4, further comprising the step of forming a vertical magnetic field generating coil by shaping said highly electroconductive metal remaining, after the infiltration into said porous sintered body, into said electrode support member and said vertical magnetic field generating coil.

9. A method according to claim 5, further comprising the step of forming a vertical magnetic field generating coil by shaping said highly electroconductive metal remaining, after the infiltration into said porous sintered body, into said electrode support member and said vertical magnetic field generating coil.

* * * * *